United States Patent [19]

Hayashi et al.

[11] Patent Number: 5,077,264

[45] Date of Patent: Dec. 31, 1991

[54] CYAN DYE-DONOR ELEMENT USED IN THERMAL TRANSFER AND THERMAL TRANSFER SHEET USING IT

[75] Inventors: Yoshiaki Hayashi; Taira Fujita, both of Osaka; Takehiro Kusumoto, Hyogo; Takeshi Hioki, Osaka, all of Japan

[73] Assignee: Sumitomo Chemical Company, Ltd., Osaka, Japan

[21] Appl. No.: 451,318

[22] Filed: Dec. 15, 1989

[30] Foreign Application Priority Data

Dec. 19, 1988 [JP] Japan ..... 63-319731

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,032,691 | 6/1977 | Kido et al. | 428/500 |
| 4,695,287 | 9/1987 | Evans et al. | 503/227 |

FOREIGN PATENT DOCUMENTS

| | | | |
|---|---|---|---|
| 0209991 | 1/1987 | European Pat. Off. | 503/227 |
| 0270677 | 4/1987 | European Pat. Off. . | |
| 60-239289 | 11/1985 | Japan | 503/227 |
| 60-64595 | 11/1986 | Japan | 503/227 |
| 60-268494 | 11/1986 | Japan | 503/227 |
| 60-268495 | 11/1986 | Japan | 503/227 |
| 63-114690 | 9/1988 | Japan | 503/227 |
| 2159971 | 12/1985 | United Kingdom | 503/227 |

*Primary Examiner*—Bruce H. Hess

*Attorney, Agent, or Firm*—Cushman, Darby & Cushman

[57] ABSTRACT

A cyan dye-donor element which gives good printed images to a thermal-transfer sheet and a thermal-transfer sheet comprising a substrate sheet and a layer containing said cyan dye-donor and being laid on one side of the substrate sheet are provided. The cyan dye-donor element comprises cyan dyes dispersed or dissolved in a polymeric binder wherein said cyan dyes comprise:

(I)

wherein $R_1$ and $R_2$ each represents a hydrogen atom or a $C_1$–$C_6$ alkyl group; at least one dye represented by the following formula (II):

(II)

wherein $R_3$ and $R_4$ each represents a hydrogen atom or a $C_1$–$C_6$ alkyl group which may be substituted, and $R_5$ represents a hydrogen atom or a $C_1$–$C_6$ alkyl group; and at least one dye selected from the group consisting of dyes represented by the following formula (III):

(III)

wherein $R_6$ and $R_7$ each represents a hydrogen atom or a $C_1$–$C_6$ alkyl group which may be substituted, $R_8$ represents a hydrogen atom, a $C_1$–$C_6$ alkyl group which (List continued on next page.)

may be substituted, an alkoxy group which may be substituted or an acylamino group which may be substituted and $R_9$ represents a hydrogen atom, a $C_1$–$C_6$ alkyl group which may be substituted or an aryl group which may be substituted, dyes represented by the following formula (IV):

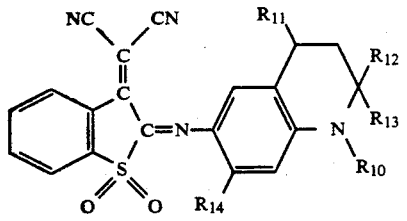

(IV)

wherein $R_{10}$ represents a hydrogen atom, a $C_1$–$C_6$ alkyl group which may be substituted, an aryl group which may be substituted or a cyclohexyl group, $R_{11}$–$R_{13}$ each represents a hydrogen atom or a $C_1$–$C_6$ alkyl group which may be substituted, and $R_{14}$ represents a hydrogen atom or a $C_1$–$C_6$ alkyl group which may be substituted or an alkoxy group which may be substituted, and dyes represented by the following formula (V):

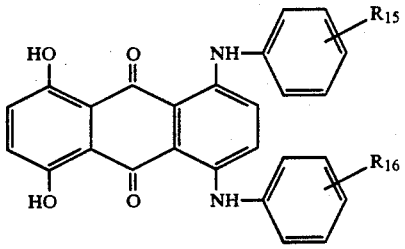

wherein $R_{15}$ and $R_{16}$ each represents a hydrogen atom or a $C_1$–$C_6$ alkyl group which may be substituted.

23 Claims, 3 Drawing Sheets

CYAN DYE-DONOR ELEMENT USED IN THERMAL TRANSFER AND THERMAL TRANSFER SHEET USING IT

BACKGROUND OF THE INVENTION

The present invention relates to a cyan dye-donor element used in thermal transfer according to a thermal transfer-recording and a thermal transfer sheet using the same for color hard copies.

A method of printing image by thermal transfer, i.e., pictures are formed by causing dyes to sublimate or vaporize by heat, has come into the limelight recently as a method for obtaining color hard copies from televisions, CRT color displays, color facsimiles, magnetic cameras, and others. A thermal source in this method includes heating elements such as thermal head and since transfer amount of dye can be controlled according to thermal energy given, good continuous gradation color image can be obtained.

According to this method, sublimating or vaporizing dye coated on a substrate of thermal transfer sheet is transfer printed on an image receiving material by a thermal head controlled by image signal and full color images can be formed by using thermal transfer sheets having dyes of the three primary colors of yellow, magenta and cyan. Such thermal transfer sheet has been produced by selecting dyes having relatively good sublimatability or vaporizability and superior hue and fastness from various dyes such as disperse dyes and basic dyes (e.g., U.S. Pat. No. 4,695,287, Japanese Patent Kokai Nos. 60-239289, 61-268494, 61-268495, 62-64595 and European Patent No. 209991 (=Japanese Patent Kokai No. 63-15790).

Dyes used in thermal transfer sheet must satisfy various requirements as enumerated below and only when these requirements are satisfied, good image can be obtained.

(1) The dyes must have good solubility and dispersibility in resin or solvent component used in making thermal transfer sheet by coating a dye layer on a transfer substrate.

(2) The dyes must be easily diffused, sublimated or vaporized with heat onto an image receiving material (image printing layer) from a heat transfer sheet and have good affinity for resin of an image receiving material.

(3) The dyes must have optimum color characteristics, namely, hue, density and chroma as three primary colors for full color display in an image printing layer.

(4) The dyes must afford images excellent in fastness such as light resistance and migration resistance.

Various proposals have been made to satisfy the requirements for dyes and, for example, it has been proposed to use dyes having specific chemical structure or dyes having limited molecular weight and I/O value.

However, satisfactory dyes have not yet been obtained. Especially, cyan dyes have the defects that they are inferior in solubility in making thermal transfer sheet and they cannot give cyan color having desired hue.

SUMMARY OF THE INVENTION

The inventors have made intensive research for obtaining a cyan color thermal transfer sheet which can satisfy the above-mentioned requirements and, as a result, have found that the above object is attained by using specific at least three dyes in combination.

Figure 1:
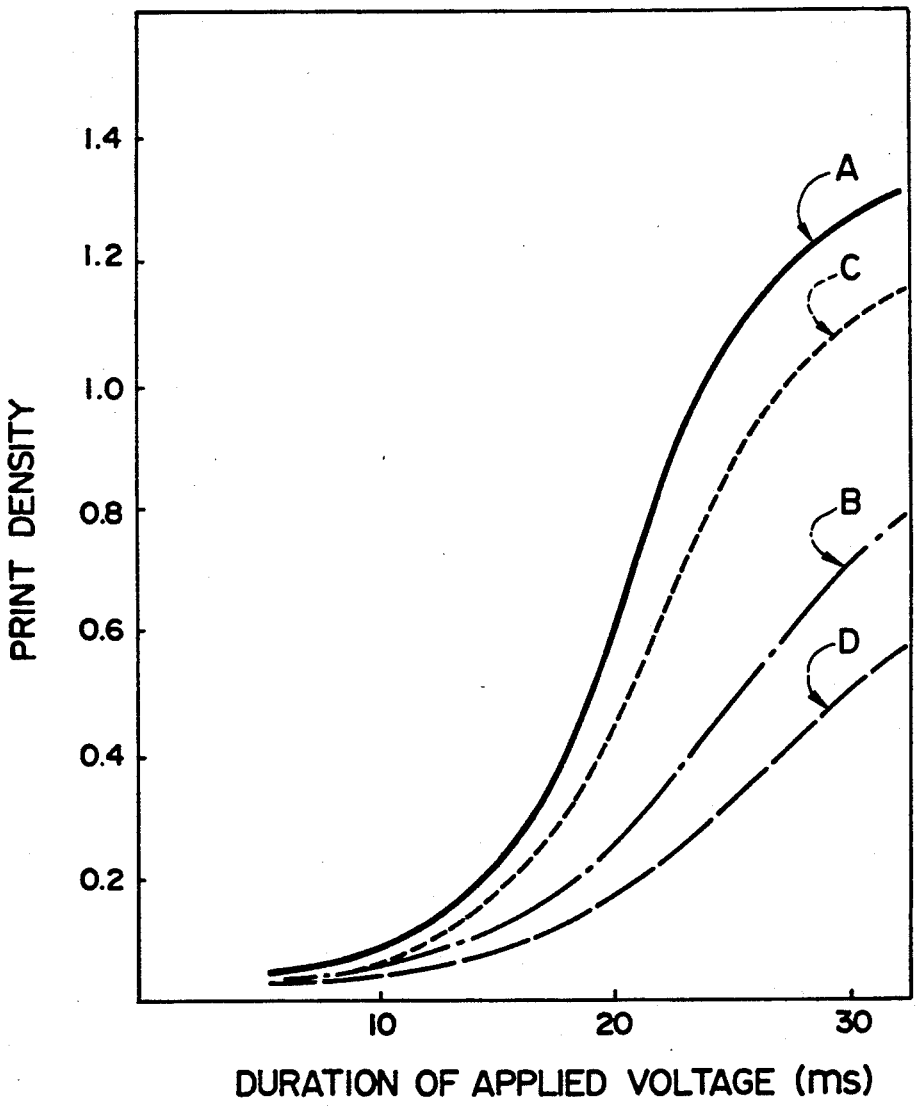
FIG. 1 is a graph which shows correlation between duration of applied thermal energy and printing density wherein data A, B, C and D indicate change when the transfer sheets obtained in Example 1, Comparative Example 1, Comparative Example 2 and Comparative Example 3 are used, respectively.

FIGS. *2a* and *2b* are graphs which show change of spectral reflection density in visible light region wherein data A, E and F in FIG. *2a* show the changes in Example 1, Reference Example 1 and Reference Example 2 and data B, C, D, E and F in FIG. *2b* show the changes in Comparative Examle 1, Comparative Example 2, Comparative Example 3, Reference Example 1 and Reference Example 2, respectively.

DESCRIPTION OF THE INVENTION

The present invention provides a cyan dye-donor element for thermal transfer which comprises cyan dye dispersed or dissolved in a polymeric binder and a thermal transfer sheet using the same, characterized in that the cyan dye is a mixture of at least one dye represented by the following formula (I):

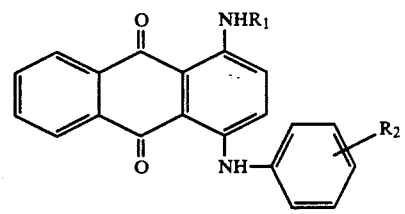

(I)

(wherein $R_1$ and $R_2$ each represents a hydrogen atom or a $C_1$–$C_6$ alkyl group) and at least one dye represented by the following formula (II):

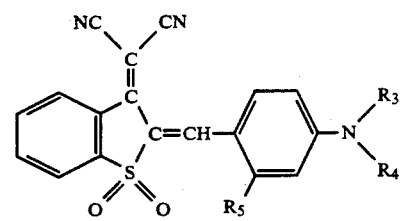

(II)

(wherein $R_3$ and $R_4$ each represents a hydrogen atom or a $C_1$–$C_6$ alkyl group which may be substituted, and $R_5$ represents a hydrogen atom or a $C_1$–$C_6$ alkyl group) and at least one dye selected from the group consisting of dyes represented by the formula (III):

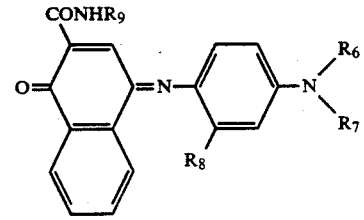

(III)

(wherein $R_6$ and $R_7$ each represents a hydrogen atom or a $C_1$–$C_6$ alkyl group which may be substituted, $R_8$ represents a hydrogen atom, a $C_1$–$C_6$ alkyl group which may be substituted, an alkoxy group which may be substituted or an acylamino group which may be substituted and $R_9$ represents a hydrogen atom, a $C_1$–$C_6$ alkyl group which may be substituted or an aryl group which may be substituted), dyes represented by the formula (IV):

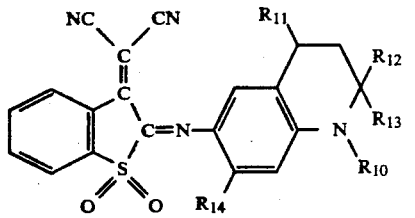

(IV)

(wherein $R_{10}$ represents a hydrogen atom, a $C_1$–$C_6$ alkyl group which may be substituted, an aryl group which may be substituted or a cyclohexyl group, $R_{11}$–$R_{13}$ each represents a hydrogen atom or a $C_1$–$C_6$ alkyl group which may be substituted, and $R_{14}$ represents a hydrogen atom, a $C_1$–$C_6$ alkyl group which may be substituted or an alkoxy group which may be substituted) and dyes represented by the formula (V):

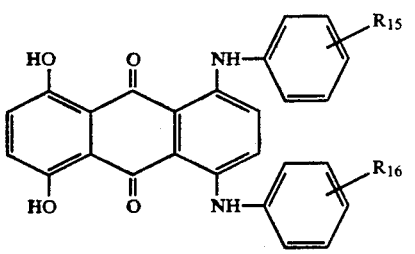

(V)

(wherein $R_{15}$ and $R_{16}$ each represents a hydrogen atom or a $C_1$–$C_6$ alkyl group which may be substituted.)

The characteristic of the present invention is to use at least three dyes in admixture as mentioned above. The dye represented by the formula (I) alone does not have the desired cyan color, and is not sufficient in solubility at preparation of a transfer sheet. On the other hand, the dye represented by the formula (II) alone is sufficient in solubility but color is reddish and a little far from desired cyan color. Furthermore, the dyes represented by the formula (III), (IV) and/or (V) alone have greenish color which is much different from the desired cyan color, and are insufficient in solubilities and transferabilities at preparation of a transfer sheet.

It has been found that the desired cyan color is obtained and furthermore solubility and transfer characteristics are considerably improved by synergistic effect of three or more dyes and thus the above problems all are solved by using the dyes represented by the formulas (I) and (II), and further in combination with at least one dye selected from the group consisting of dyes represented by the formulas (III), (IV) and (V).

Especially preferred $R_1$ and $R_2$ in the formula (I) include a hydrogen atom, a methyl group, an ethyl group and a propyl group.

Preferred $R_3$ and $R_4$ in the formula (II) are a methyl group, an ethyl group, a propyl group, a butyl group, a pentyl group or a hexyl group.

Preferred $R_5$ is a hydrogen atom, a methyl group or an ethyl group.

Preferred $R_6$ and $R_7$ in the formula (III) are a methyl group, an ethyl group, a propyl group, a butyl group, a hydroxyethyl or a benzyl group.

Preferred $R_8$ is a hydrogen atom, a methyl group, an ethyl group, a methoxy group or an ethoxy group.

Preferred $R_9$ is an ethyl group, a propyl group, a butyl group, a phenyl group or a hydroxyethyl group.

Preferred $R_{10}$ in the formula (IV) is a methyl group, an ethyl group, a propyl group, a butyl group, a hydroxyethyl group or a benzyl group.

Preferred $R_{11}$ to $R_{13}$ are a methyl group, an ethyl group, a propyl group or a butyl group.

Preferred $R_{14}$ is a hydrogen atom, a methyl group, an ethyl group, a methoxy group or an ethoxy group.

Preferred $R_{15}$ and $R_{16}$ in the formula (V) are a methyl group, an ethyl group, a propyl group, a butyl group, a hydroxyethyl group or a benzyl group.

The compound represented by the formula (I) is a dye known per se and is easily produced, for example, by stepwise reaction of a compound represented by the formula (1):

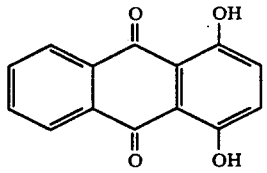

(1)

with a corresponding alkylamine or allylamine.

The compound represented by the formula (II) is also known per se and is produced, for example, by formylation of a compound represented by the formula (2):

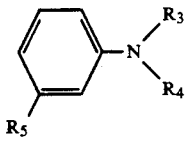

(2)

wherein $R_3$, $R_4$, and $R_5$ are as defined above, by a Vilsmeier reaction and then condensing the product with a compound represented by the formula (3):

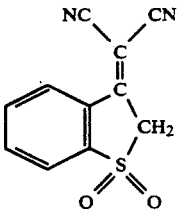

(3)

Furthermore, the compound represented by the formula (III) is also known per se and is produced, for example, by heating a compound represented by the formula (4):

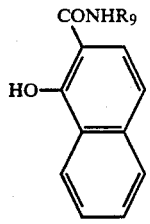

(4)

wherein $R_9$ is as defined above, and a compound represented by the formula (5):

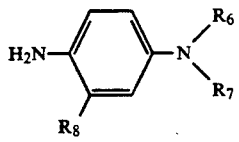

(5)

wherein $R_6$, $R_7$ and $R_8$ are as defined above, in the presence of silver nitrate.

Moreover, the compound represented by the formula (IV) is known per se and is disclosed, for example, in Japanese Patent Kokai No. 64-38053.

Further, the dyes represented by the formula (V) are obtained, for example, by allowing a compound represented by the formula (6):

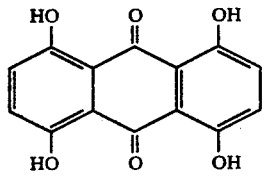

(6)

to react with the corresponding arylamines.

The transfer sheet of the present invention is characterized by containing a mixture of at least three varieties of dyes, i.e., at least one dye represented by the formula (I) and at least one dye represented by the formula (II) and at least one dye selected from a group consisting of dyes represented by the formulas (III), (IV) and (V). The blending ratio of these dyes is preferably 5–60 % by weight of the dye of the formula (I), 1–50 % by weight of the dye of the formula (II) and 10–70 % by weight (based on the total amount of the dyes of the formulas (I), (II), (III), (IV) and (V)) of the dye of the formulas (III), (IV) and/or (V). More preferably, an amount of the dye of the formula (I) is 10–50 % by weight, an amount of the dye of the formula (II) is 5–40 % by weight and an amount of the dye of the formulas (III), (IV) and/or (V) is 15–60 % by weight. If necessary, this dye mixture may further contain other dyes.

Dyes represented by the formulas (I) and (II) and (III), (IV) and/or (V) are previously mixed and the mixture is dispersed or dissolved in a suitable polymeric binder to prepare ink and this ink is coated on one side of a substrate and dried to form a cyan dye-carrying layer. Thus, a thermal transfer sheet is obtained.

The substrate includes, for example, capacitor paper, cellophane, polyimide resin, polyester resin, and polyether sulfon resin.

This substrate is preferably in the form of a ribbon or film, on one side of which is formed a cyan dye-carrying layer and another side of which is subjected to treatments for improvement of heat resistance and/or improvement of smoothness.

Ink is prepared by dissolving or dispersing dyes represented by the formulas (I) and (II) and (III), (IV) and/or (V) in a polymeric binder and a solvent, if necessary, together with other known additives (such as anti-tack agents, antioxidants and ultraviolet absorbers), in a ball mill or a paint conditioner.

As examples of the polymeric binder, mention may be made of natural resins such as gum dammar, gum arabic, gum tragacanth, dextrin and casein, and their modified resins; cellulose resins such as methylcellulose, ethylcellulose, hydroxyethylcellulose, ethylhydroxycellulose, ethylhydroxyethylcellulose and nitrocellulose; acrylic resins; vinyl resins such as polyvinyl alcohol and polyvinyl acetate. These may be used alone or in combination of two or more.

As examples of the solvent, mention may be made of water; alcohols such as ethanol, propanol and butanol; ketones such as acetone, methyl ethyl ketone and methyl isobutyl ketone; aromatic hydrocarbons such as toluene, xylene and monochlorobenzene; chlorinated solvents such as dichloroethane, trichloroethylene and perchloroethylene; and acetate esters such as ethyl acetate, butyl acetate and ethoxyethyl acetate. These may be used alone or in combination of two or more.

A dye ink obtained is coated on a substrate by a bar coater, a roll coater, a knife coater, a screen printer, a gravure printer or the like and thus a thermal transfer sheet is obtained.

Printing with the resulting thermal transfer sheet is conducted by any known methods and clear image is obtained on printing paper.

The printing paper includes, for example, polyester resin- or polyamide resin-coated papers, synthetic papers such as polypropylene, polyvinyl chloride and polyester, and these synthetic papers which are subjected to a treatment for improvement of heat resistance and then, if necessary, coated with polyester resin, polyamide resin or the like which are high in affinity for dyes.

The thermal transfer sheet obtained by using the mixed dyes according to the present invention has the following effects superior to those of thermal transfer sheet made by using conventional dyes.

(1) Solubility or dispersibility of dye in resin film of the transfer sheet is excellent and hence good transferability is exhibited at transfer to an image receiving sheet by a thermal head.

(2) The dyes are excellent in heat diffusibility, vaporizability or sublimatability onto an image receiving sheet from the thermal transfer sheet.

(3) The image printing layer obtained by thermal transfer has hue, density and chroma excellent especially as cyan among three primary colors.

(4) The thermal transfer sheet is excellent in fastnesses such as light resistance and migration resistance.

(5) The thermal transfer sheet is excellent in storage stability and besides shows little blotting of dye in an image printing layer and excellent pattern reproducibility.

The present invention will be explained in more detail by the following examples in which "part" is by weight.

EXAMPLE 1

(i) Preparation of Ink

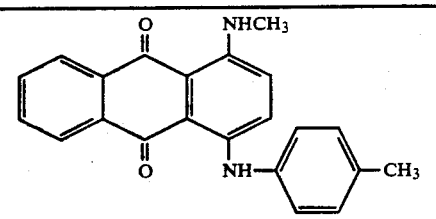

(I-1)

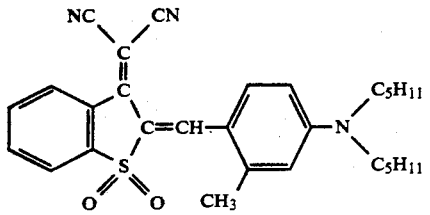

(II-1)

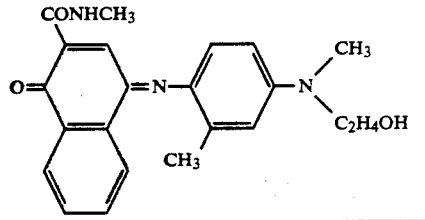

(III-1)

| | |
|---|---|
| Ethylcellulose | 6.0 parts |
| Dye of the above formula (I-1) | 0.6 part |
| Dye of the above formula (II-1) | 0.2 part |
| Dye of the above formula (III-1) | 1.2 parts |
| Toluene | 46 parts |
| Methyl ethyl ketone | 46 parts |
| Total | 100 parts |

A mixture of the above composition was sufficiently kneaded in a paint conditioner with glass beads to prepare ink.

(ii) Production of a thermal transfer sheet

The ink prepared in the above (i) was coated at a wet thickness of 12 μm on a polyester film of 6 μm thick which had been subjected to a heat-resisting treatment by a bar coater and was dried at 80° C. by a hot-air drier to obtain a thermal transfer sheet. This transfer sheet had good condition with no crystallization of dye.

(iii) Production of an image receiving sheet

Synthetic paper (YUPO #150 manufactured by Oji Yuka Co.) was coated with a 20 wt% solution of a saturated polyester resin (BYRON 200 manufactured by Toyobo Co., Ltd.) in toluene/methyl ethyl ketone at a wet thickness of 12 μm by a bar coater, followed by drying at 80° C. for 30 minutes by a hot-air drier.

(iv) Transfer printing

The above thermal transfer sheet was put on the above image receiving sheet so that the surface of ink layer on the thermal transfer sheet and the surface of coating layer on the image receiving sheet were brought into close contact with each other and thermal transfer printing was carried out using a heat-sensitive head (8 volts, 31 milliseconds) having 200 ohm heating resistor in 4 dots/mm density.

(v) Evaluation of properties of printed image (1) Color density: This was measured by densitometer RD-914 (manufactured by Macbeth Co.) and the results are shown in FIG. 1 (mark: A).

Figure 2A:
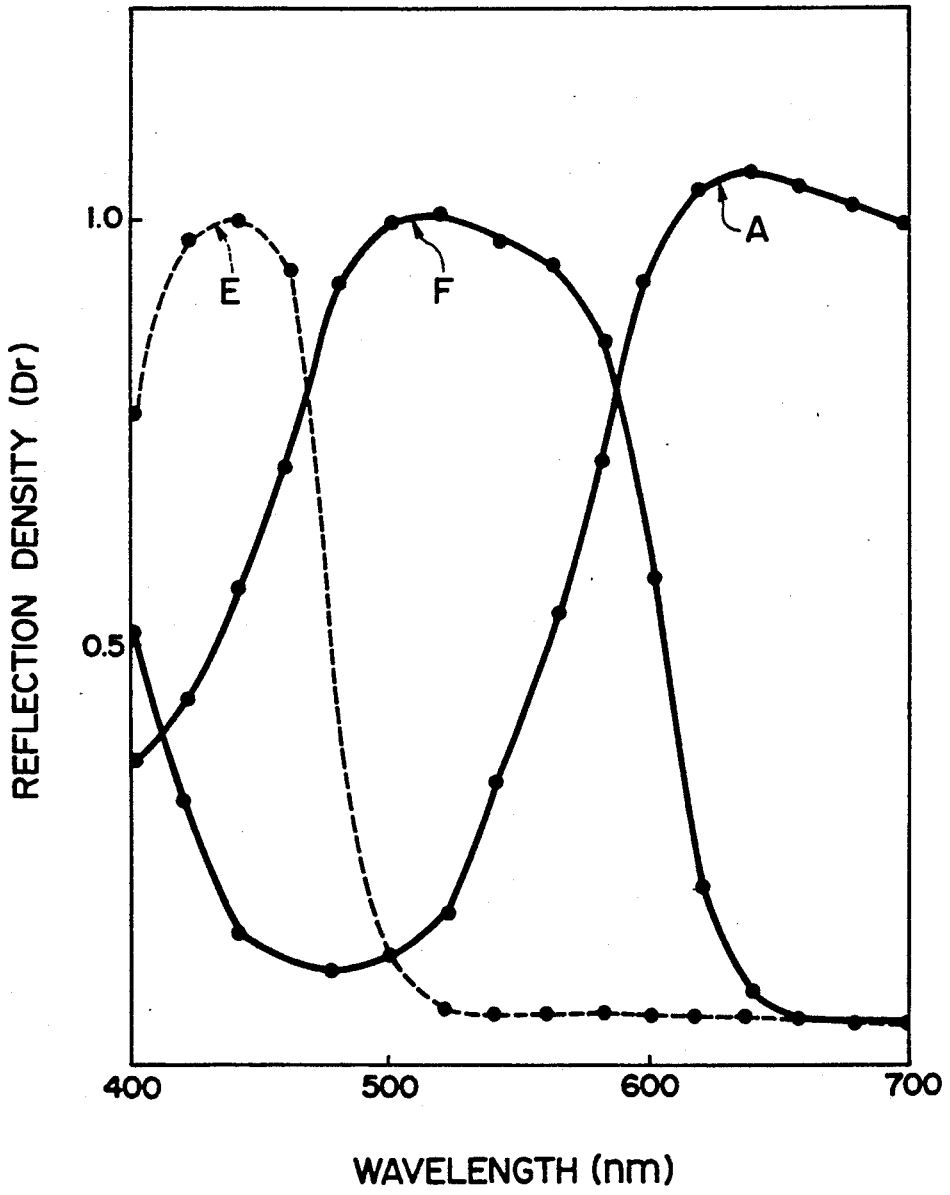

(2) Spectral reflection density: Reflectance of the image was measured by a spectral reflectance measuring device: SICOMUC 20 (manufactured by Sumika Analysis Center) and reflection density Dr at respective visible wavelengths was calculated from the obtained reflectance R by the following formula and the results are shown in FIG. 2*a* (mark: A).

Reflection density $Dr = \log_{10}(100/R)$ (3) Light resistance: The image was subjected to irradiation by a carbon arc fadeometer CF-20S (manufactured by Shimadzu Seisakusho, Ltd.) for 40 hours to find substantially no discoloration.

(4) Migration resistance: White paper was superposed on the printed image and this was left to stand in conditions of temperature 60° C. and humidity 80% for 3 days, but substantially no migration of the image to the white paper was recognized.

COMPARATIVE EXAMPLES 1, 2 AND 3

Dye inks having the following compositions were prepared in the same manner as in Example 1 except that single dye was used in place of the dye mixture.

| | Comparative Example 1 | Comparative Example 2 | Comparative Example 3 |
|---|---|---|---|
| Ethyl cellulose | 6 parts | 6 parts | 6 parts |
| Dye of the formula (I-1) | 2 parts | 0 parts | 0 parts |
| Dye of the formula (II-1) | 0 parts | 2 parts | 0 parts |
| Dye of the formula (III-1) | 0 parts | 0 parts | 2 parts |
| Toluene | 46 parts | 46 parts | 46 parts |
| Methyl ethyl ketone | 46 parts | 46 parts | 46 parts |
| Total | 100 parts | 100 parts | 100 parts |

Then, production of a thermal transfer sheet, transfer printing, and evaluation of printed image were conducted in the same manner as in Example 1 and the results are shown in FIG. 1 as Comparative examples [mark: B (Comparative Example 1), mark: C (Comparative Example 2), mark: D (Comparative Example 3].

Reference Examples 1 and 2

Figure 2B:
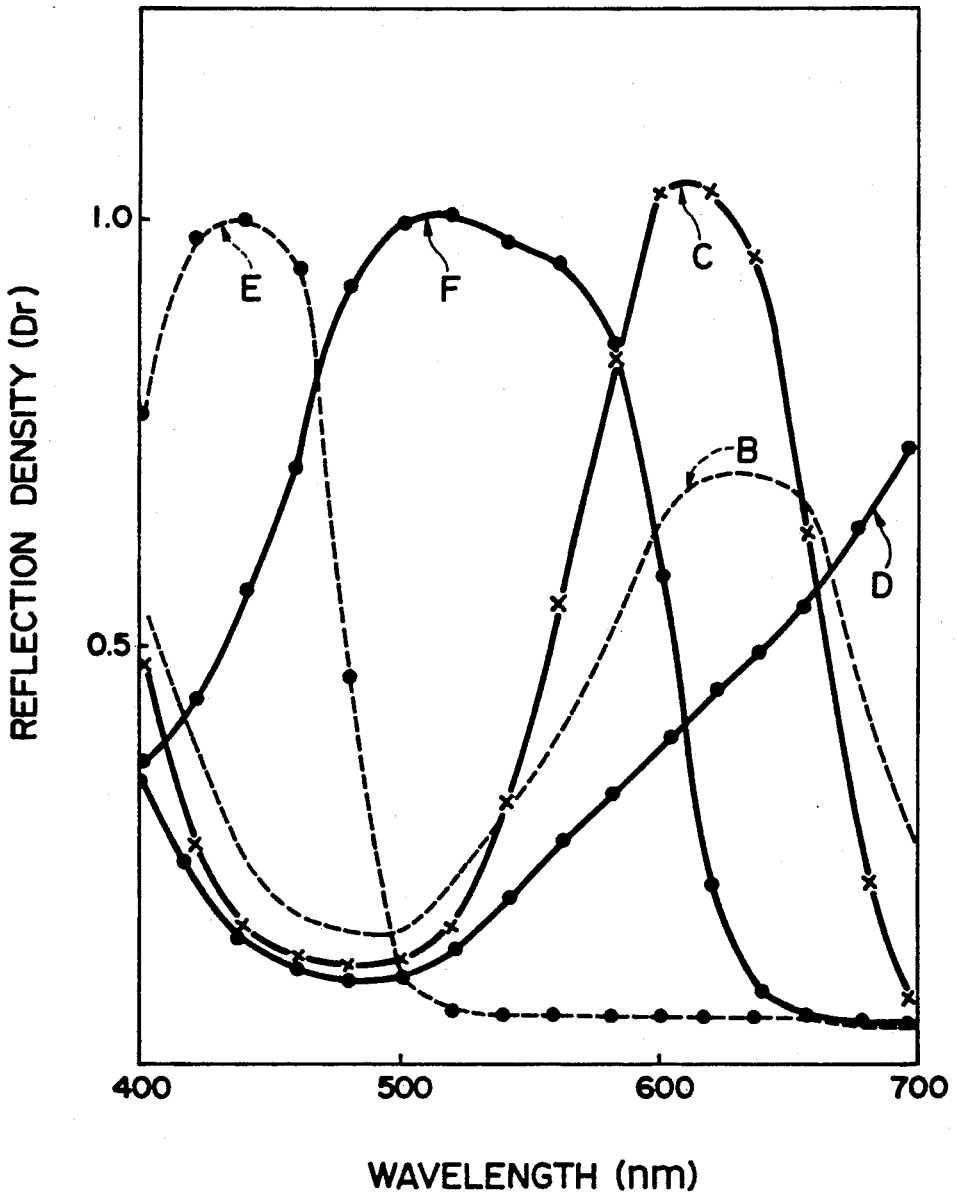

Using inks of the following compositions for yellow and magenta (Reference Examples 1 and 2), production of a thermal transfer sheet, transfer printing and evaluation of printed image were conducted in the same manner as in Example 1 and the results are shown in FIGS. 2*a* and 2*b* [mark: E (Reference Example 1), F (Reference Example 2)].

| | Reference Example 1 | Reference Example 2 |
|---|---|---|
| Ethylcellulose | 6 parts | 6 parts |

-continued

| | Reference Example 1 | Reference Example 2 |
|---|---|---|
| 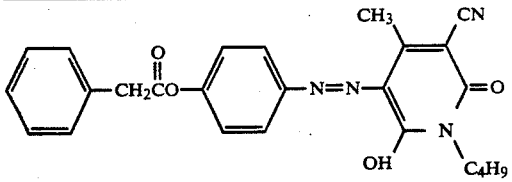 | 2 parts | 0 parts |
| 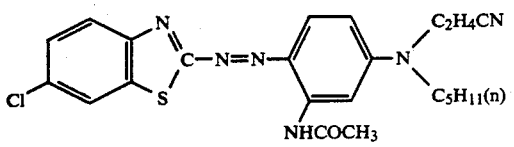 | 0 parts | 0.6 parts |
| 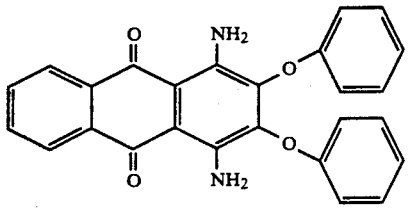 | 0 parts | 1.4 parts |
| Toluene | 46 parts | 46 parts |
| Methyl ethyl ketone | 46 parts | 46 parts |
| Total | 100 parts | 100 parts |

EXAMPLE 2

(I-2)

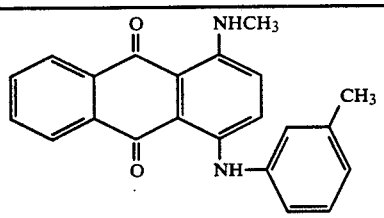

(II-2)

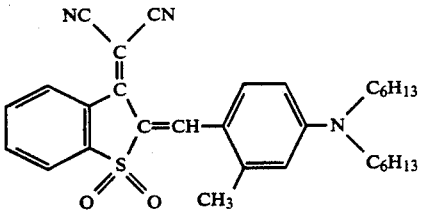

(III-2)

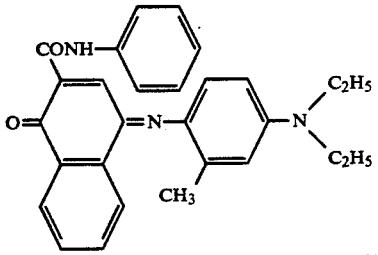

| | |
|---|---|
| Ethylhydroxyethylcellulose | 6.0 parts |
| Dye of the above formula (I-2) | 0.6 part |
| Dye of the above formula (II-2) | 0.4 part |
| Dye of the above formula (III-2) | 1.0 part |
| Toluene | 46.0 parts |
| Methyl ethyl ketone | 46.0 parts |

-continued

| | |
|---|---|
| Total | 100 parts |

A mixture of the above composition was sufficiently kneaded in a paint conditioner using glass beads to obtain ink. Then, in the same manner as in Example 1, production of a thermal transfer sheet, transfer printing, and evaluation of properties of printed image were carried out to obtain good results as in Example 1.

EXAMPLE 3

(I-3)

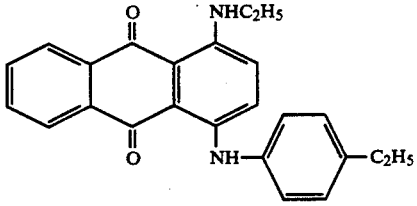

(II-1)

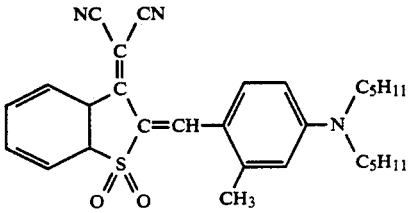

-continued (III-3)

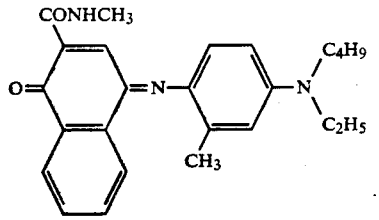

| | |
|---|---|
| Ethylcellulose | 6.0 parts |
| Dye of the above formula (I-3) | 0.3 part |
| Dye of the above formula (II-1) | 0.6 parts |
| Dye of the above formula (III-3) | 1.1 parts |
| toluene | 46.0 parts |
| Methyl ethyl ketone | 46.0 parts |
| Total | 100 parts |

A mixture of the above composition was sufficiently kneaded in a paint conditioner using glass beads to obtain ink. Then, in the same manner as in Example 1, production of a thermal transfer sheet, transfer printing, and evaluation of properties of printed image were carried out to obtain good results as in Example 1.

EXAMPLE 4

(I-4)

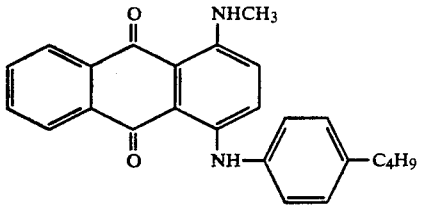

(II-3)

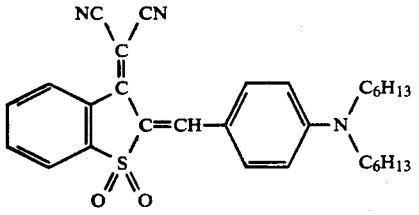

(III-4)

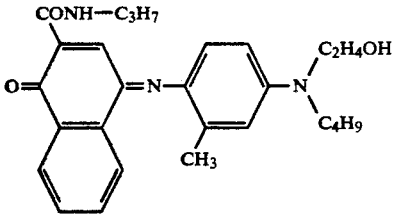

| | |
|---|---|
| Ethylcellulose | 6.0 parts |
| Dye of the above formula (I-4) | 0.8 part |
| Dye of the above formula (II-3) | 0.5 part |
| Dye of the above formula (III-4) | 0.7 part |
| Toluene | 46.0 parts |
| Methyl ethyl ketone | 46.0 parts |
| Total | 100 parts |

A mixture of the above composition was sufficiently kneaded in a paint using glass beads to obtain ink. Then, in the same manner as in Example 1, production of a thermal transfer sheet, transfer printing, and evaluation of properties of printed image were carried out to obtain good results as in Example 1.

EXAMPLE 5

(I-2)

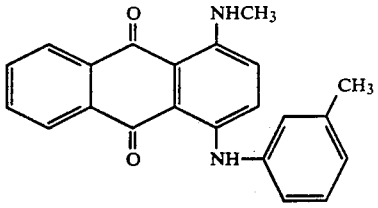

(II-2)

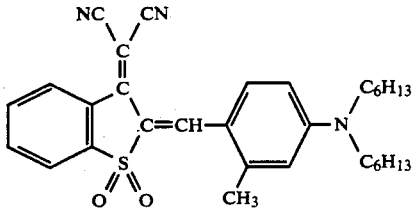

(IV-1)

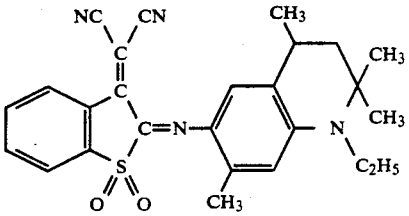

| | |
|---|---|
| Ethylhydroxyethylcellulose | 6.0 parts |
| Dye of the above formula (I-2) | 0.6 part |
| Dye of the above formula (II-2) | 0.5 part |
| Dye of the above formula (IV-1) | 0.9 part |
| Toluene | 46.0 parts |
| Methyl ethyl ketone | 46.0 parts |
| Total | 100 parts |

A mixture of the above composition was sufficiently kneaded in a paint conditioner using glass beads to obtain ink. Then, in the same manner as in Example 1, production of thermal transfer sheet, transfer printing, and evaluation of properties of printed image were carried to obtain good results as in Example 1.

EXAMPLE 6

(I-3)

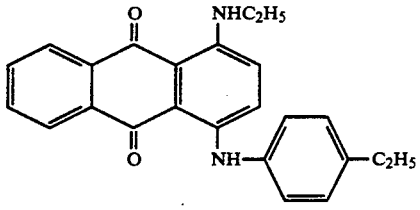

(II-3)

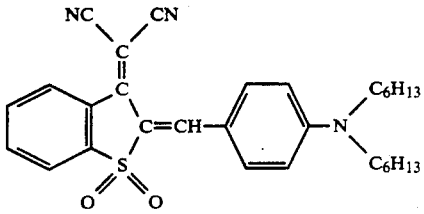

-continued (IV-2)

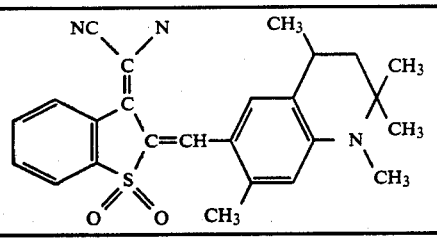

| | |
|---|---|
| Ethyl cellulose | 6.0 parts |
| Dye of the above formula (I-3) | 0.6 part |
| Dye of the above formula (II-3) | 0.4 part |
| Dye of the above formula (IV-2) | 1.0 part |
| Toluene | 46.0 parts |
| Methyl ethyl ketone | 46.0 parts |
| Total | 100 parts |

A mixture of the above composition was sufficiently kneaded in paint conditioner using glass beads to obtain ink. Then production of a thermal transfer sheet, transfer printing, and evaluation of properties of printed image were carried out in the same manner as in Example 1, to obtain good results as in Example 1.

EXAMPLE 7

(I-4)

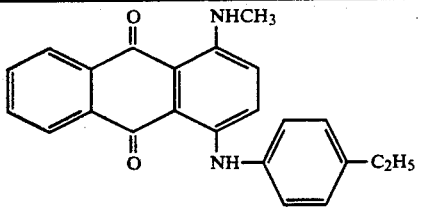

(II-3)

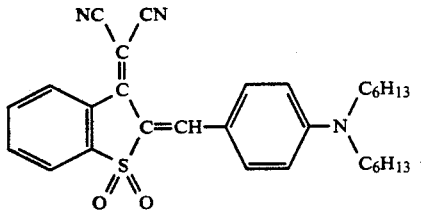

(V-1)

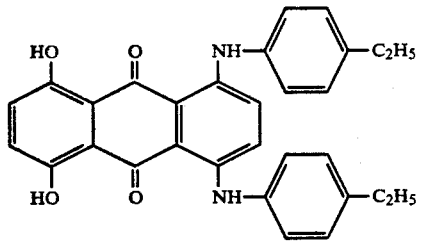

| | |
|---|---|
| Ethyl cellulose | 6.0 parts |
| Dye of the above formula (I-4) | 0.8 part |
| Dye of the above formula (II-3) | 0.6 part |
| Dye of the above formula (V-1) | 0.6 part |
| Toluene | 46.0 parts |
| Methyl ethyl ketone | 46.0 parts |
| Total | 100 parts |

A mixture of the above composition was sufficiently kneaded in a paint conditioner using glass beads to obtain ink. Then, in the same manner as in Example 1, production of a thermal transfer sheet, transfer printing and evaluation of properties of printed image were carried out to obtain good results as in Example 1.

EXAMPLE 8

(I-2)

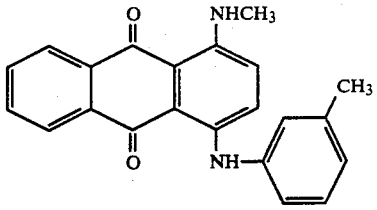

(II-2)

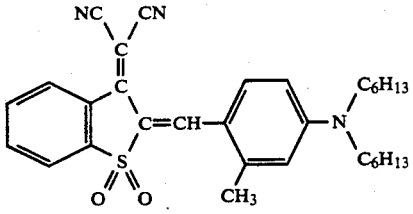

(V-2)

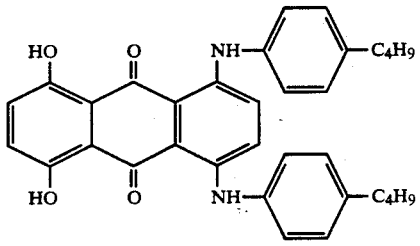

| | |
|---|---|
| Ethylhydroxyethyl cellulose | 6.0 parts |
| Dye of the above formula (I-2) | 0.8 part |
| Dye of the above formula (II-2) | 0.8 part |
| Dye of the above formula (V-2) | 0.4 part |
| Toluene | 46.0 parts |
| Methyl ethyl ketone | 46.0 parts |
| Total | 100 parts |

A mixture of the above composition was sufficiently kneaded in paint conditioner using glass beads to obtain ink. Then, and in the same manner as in Example 1, production of a thermal transfer sheet, transfer printing, and evaluation of properties of printed image were carried out to obtain good results as in Example 1.

Results of evaluation of the transfer sheets obtained in Examples 1–8 and Comparative Examples 1–3 are shown in Table 1.

TABLE 1

| | Condition of transfer sheet | Maximum record density | Color of cyan as used for full color* |
|---|---|---|---|
| Example 1 | Good | 1.30 | ○ |
| Example 2 | " | 1.40 | ○ |
| Example 3 | " | 1.28 | ○ |
| Example 4 | " | 1.35 | ○ |
| Example 5 | " | 1.37 | ○ |
| Example 6 | " | 1.33 | ○ |
| Example 7 | " | 1.24 | ○ |
| Example 8 | " | 1.30 | ○ |
| Comparative Example 1 | Crystal was precipitated | 0.75 | X |
| Comparative Example 2 | Good | 1.15 | Δ |
| Comparative | Crystal was | 0.46 | X |

TABLE 1-continued

| | Condition of transfer sheet | Maximum record density | Color of cyan as used for full color* |
|---|---|---|---|
| Example 3 | precipitated | | |

*When cyan color was used as one element of full color, one which had a spectral reflection density curve near that of the ideal cyan color is indicated by "○", one which had a spectral reflection density curve of somewhat inferior cyan color is indicated by "Δ", and one which had a spectral reflection density curve of considerably inferior cyan color is indicated by "X". Some examples thereof are shown in FIGS. 2a and 2b.

What is claimed is:

1. A cyan dye-donor element for thermal transfer which comprises a cyan dye dispersed or dissolved in a polymeric binder, said cyan dye comprising at least one dye represented by the following formula (I):

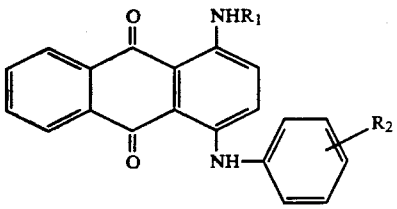

(I)

wherein $R_1$ and $R_2$ each represents a hydrogen atom or a $C_1$–$C_6$ alkyl group; at least one dye represented by the following formula (II):

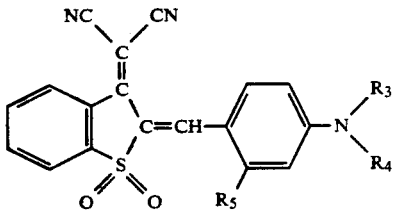

(II)

wherein $R_3$ and $R_4$ each represents a hydrogen atom or a $C_1$–$C_6$ alkyl group which may be substituted, and $R_5$ represents a hydrogen atom or a $C_1$–$C_6$ alkyl group; and at least one dye selected from the group consisting of dyes represented by the following formula (III):

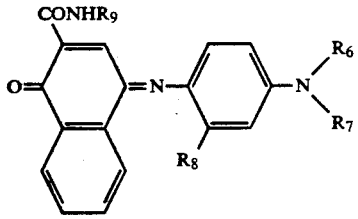

(III)

wherein $R_6$ and $R_7$ each represents a hydrogen atom or a $C_1$–$C_6$ alkyl group which may be substituted, $R_8$ represents a hydrogen atom, a $C_1$–$C_6$ alkyl group which may be substituted, an alkoxy group which may be substituted or an acylamino group which may be substituted and $R_9$ represents a hydrogen atom, a $C_1$–$C_6$ alkyl group which may be substituted or an aryl group which may be substituted, dyes represented by the following formula (IV):

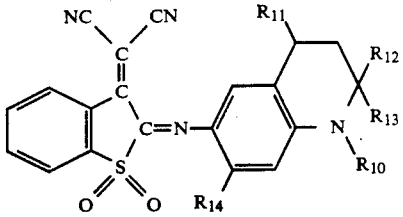

(IV)

wherein $R_{10}$ represents a hydrogen atom, a $C_1$–$C_6$ alkyl group which may be substituted, an aryl group which may be substituted or a cyclohexyl group, $R_{11}$–$R_{13}$ each represents a hydrogen atom or a $C_1$–$C_6$ alkyl group which may be substituted, and $R_{14}$ represents a hydrogen atom or a $C_1$–$C_6$ alkyl group which may be substituted or an alkoxy group which may be substituted, and dyes represented by the following formula (V):

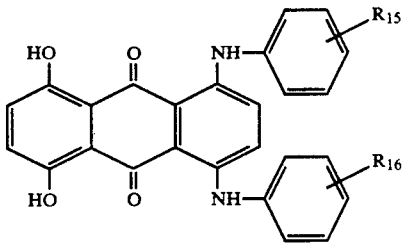

(V)

wherein $R_{15}$ and $R_{16}$ each represents a hydrogen atom or a $C_1$–$C_6$ alkyl group which may be substituted.

2. A cyan dye-donor element according to claim 1, which contains 5–60 % by weight of the dye represented by the formula (I), 1–50 % by weight of the dye represented by the formula (II) and 10–70 % by weight of at least one dye selected from the group consisting of the dyes represented by the formulas (III), (IV) and (V).

3. A cyan dye-donor element according to claim 1 which contains 10–50 % by weight of the dye represented by the formula (I), 5–40 % by weight of the dye represented by the formula (II) and 15–60 % by weight of at least one dye selected from the group consisting of the dyes represented by the formulas (III), (IV) and (V).

4. A cyan dye-donor element according to claim 1 wherein the dye represented by the formula (I) is a dye represented by the following formula (VI):

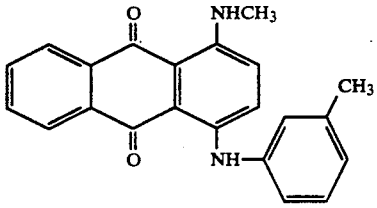

(VI)

5. A cyan dye-donor element according to claim 1, wherein the dye represented by the formula (II) is a dye represented by the formula (VII):

(VII)

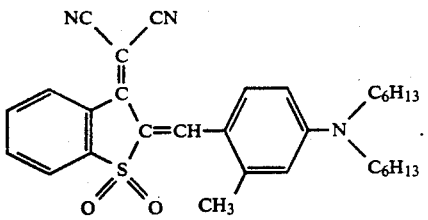

6. A cyan dye-donor element according to claim 1, wherein the dye represented by the formula (III) is a dye represented by the formula (VIII):

(VIII)

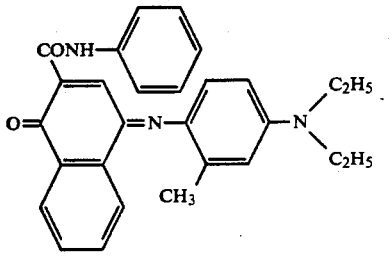

7. A cyan dye-donor element according to claim 1, wherein the dye represented by the formula (IV) is a dye represented by the formula (IX):

(IX)

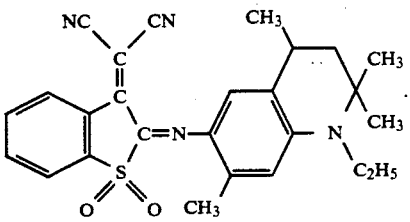

8. A cyan dye-donor element according to claim 1, wherein the dye represented by the formula (V) is a dye represented by the formula (X):

(X)

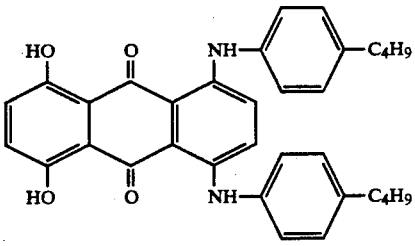

9. A cyan dye-donor element for a thermal transfer sheet which comprises cyan color dyes dispersed or dissolved in a polymeric binder wherein said cyan color dyes comprise: a dye represented by the following formula (VI):

(VI)

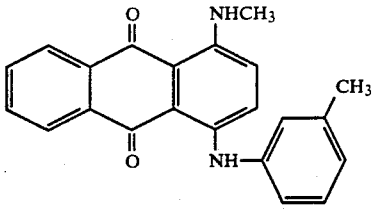

a dye represented by the following formula (VII):

(VII)

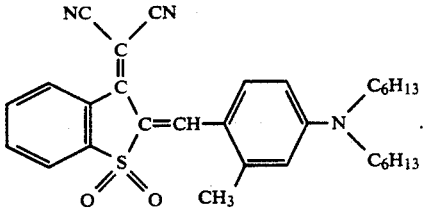

and a dye represented by the following formula (VIII):

(VIII)

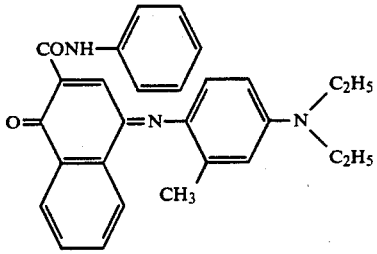

10. A cyan dye-donor element according to claim 9, wherein the dye represented by the following formula (IX) is contained in place of the dye represented by the formula (VIII):

11. A cyan dye-donor element according to claim 10, which contains 5-60 % by weight of the dye represented by the formula (VI), 1-50 % by weight of the dye represented by the formula (VII) and 10-70 % by weight of the dye represented by the formula (IX).

(IX)

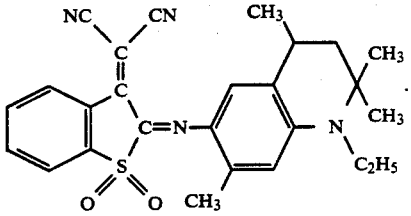

12. A cyan dye-donor element according to claim 9, wherein the dye represented by the following formula (X) is contained in place of the dye represented by the formula (VIII):

(X)

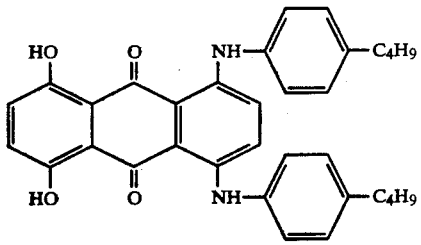

13. A cyan dye-donor element according to claim 11 which contains 5–60 % by weight of the dye represented by the formula (VI), 1–50 % by weight of the dye represented by the formula (VII) and 10–70 % by weight of the dye represented by the formula (X).

14. A cyan dye-donor element according to claim 9 which contains 5–60 % by weight of the dye represented by the formula (VI), 1–50 % by weight of the dye represented by the formula (VII) and 10–70 % by weight of the dye represented by the formula (VIII).

15. A thermal-transfer sheet which comprises a substrate sheet and a layer carrying a cyan dye-donor dispersed or dissolved in a polymeric binder and being laid on one side of said substrate sheet, wherein said cyan dye comprises at least one dye represented by the following formula (I):

(I)

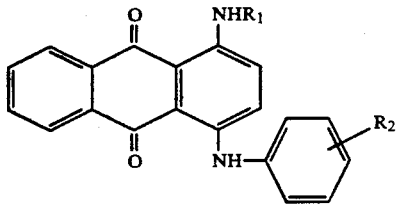

wherein $R_1$ and $R_2$ each represents a hydrogen atom or a $C_1$–$C_6$ alkyl group; at least one dye represented by the following formula (II):

(II)

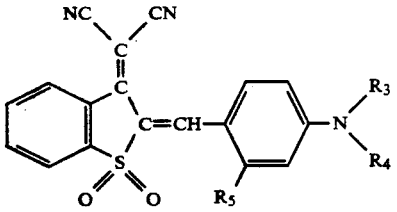

wherein $R_3$ and $R_4$ each represents a hydrogen atom or a $C_1$–$C_6$ alkyl group which may be substituted, and $R_5$ represents a hydrogen atom or a $C_1$–$C_6$ alkyl group; and at least one dye selected from the group consisting of dyes represented by the following formula (III):

(III)

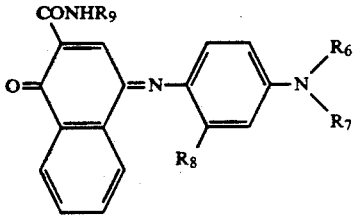

wherein $R_6$ and $R_7$ each represents a hydrogen atom or a $C_1$–$C_6$ alkyl group which may be substituted, $R_8$ represents a hydrogen atom, a $C_1$–$C_6$ alkyl group which may be substituted, an alkoxy group which may be substituted or an acylamino group which may be substituted and $R_9$ represents a hydrogen atom, a $C_1$–$C_6$ alkyl group which may be substituted or an aryl group which may be substituted, dyes represented by the following formula (IV):

(IV)

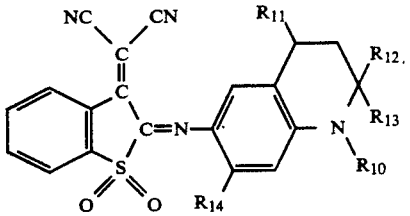

wherein $R_{10}$ represents a hydrogen atom, a $C_1$–$C_6$ alkyl group which may be substituted, an aryl group which may be substituted or a cyclohexyl group, $R_{11}$–$R_{13}$ each represents a hydrogen atom or a $C_1$–$C_6$ alkyl group which may be substituted, and $R_{14}$ represents a hydrogen atom or a $C_1$–$C_6$ alkyl group which may be substituted or an alkoxy group which may be substituted, and dyes represented by the following formula (V):

(V)

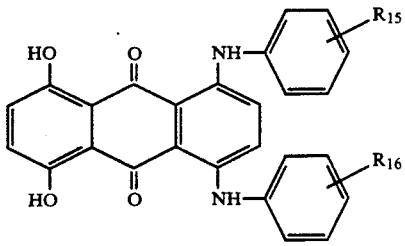

wherein $R_{15}$ and $R_{16}$ each represents a hydrogen atom or a $C_1$–$C_6$ alkyl group which may be substituted.

16. A thermal-transfer sheet according to claim 15, wherein content of the dye represented by the formula (I) is 5–60 % by weight, content of the dye represented by the formula (II) is 1–50 % by weight and content of at least one dye selected from the group consisting of the dyes represented by the formulas (III), (IV) and (V) is 10–70 % by weight.

17. A thermal-transfer sheet according to claim 15, wherein content of the dye represented by the formula (I) is 10–50 % by weight, content of the dye represented by the formula (II) is 5–40 % by weight and content of at least one dye selected from the group consisting of the dyes represented by the formulas (III), (IV) and (V) is 15–60 % by weight.

18. A thermal-transfer sheet according to claim 15, wherein the dye represented by the formula (I) is the dye represented by the following formula (VI):

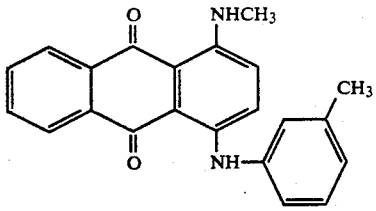

(VI)

the dye represented by the formula (II) is the dye represented by the following formula (VII):

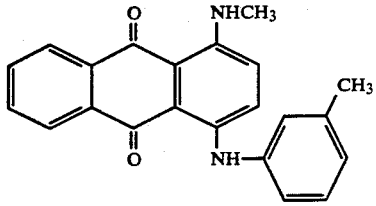

(VI)

and the dye represented by the formula (III) is the dye represented by the following formula (VIII):

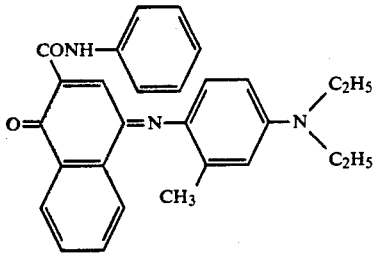

(VIII)

19. A thermal-transfer sheet according to claim 18, wherein the dye represented by the following formula (IX) is contained in place of the dye represented by the formula (VIII):

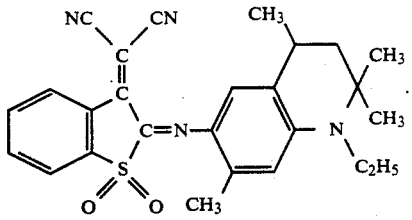

(IX)

20. A thermal-transfer sheet according to claim 19, wherein content of the dye represented by the formula (VI) is 5–60 % by weight, content of the dye represented by the formula (VII) is 1–50 % by weight and content of the dye represented by the formula (IX) is 10–70 % by weight.

21. A thermal-transfer sheet according to claim 18, wherein the dye represented by the following formula (X) is contained in place of the dye represented by the formula (VIII):

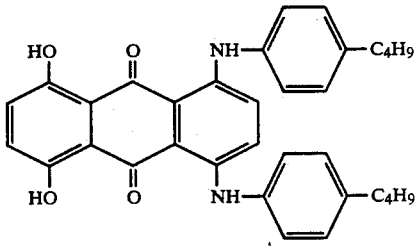

(X)

22. A thermal-transfer sheet according to claim 21, wherein content of the dye represented by the formula (VI) is 5–60 % by weight, content of the dye represented by the formula (VII) is 1–50 % by weight and content of the dye represented by the formula (X) is 10–70 % by weight.

23. A thermal-transfer sheet according to claim 18, wherein content of the dye represented by the formula (VI) is 5–60 % by weight, content of the dye represented by the formula (VII) is 1–50 % by weight and content of the dye represented by the formula (VIII) is 10–70 % by weight.

* * * * *